US009255337B2

(12) United States Patent
Derezinski et al.

(10) Patent No.: US 9,255,337 B2
(45) Date of Patent: Feb. 9, 2016

(54) METHODS AND APPARATUS FOR PROCESSING OF RARE EARTH METAL ORE

(75) Inventors: Stephen Joseph Derezinski, Wellesley, MA (US); Adam Clayton Powell, Newton, MA (US)

(73) Assignee: Infinium, Inc., Natick, MA (US)

( * ) Notice: Subject to any disclaimer, the term of this patent is extended or adjusted under 35 U.S.C. 154(b) by 92 days.

(21) Appl. No.: 13/575,657

(22) PCT Filed: Dec. 5, 2011

(86) PCT No.: PCT/US2011/063334

§ 371 (c)(1), (2), (4) Date: Jul. 27, 2012

(87) PCT Pub. No.: WO2012/078524

PCT Pub. Date: Jun. 14, 2012

(65) Prior Publication Data

US 2012/0292198 A1 Nov. 22, 2012

Related U.S. Application Data

(60) Provisional application No. 61/419,871, filed on Dec. 5, 2010.

(51) Int. Cl.

| | |
|---|---|
| ***C25C 7/00*** | (2006.01) |
| ***C25C 3/00*** | (2006.01) |
| ***C25C 3/34*** | (2006.01) |

(52) U.S. Cl.

CPC .. *C25C 7/005* (2013.01); *C25C 3/34* (2013.01)

(58) Field of Classification Search

CPC ..... C25C 3/00; C25C 3/34; C25C 7/00; C25C 7/005

USPC ..... 205/368, 334

See application file for complete search history.

(56) References Cited

U.S. PATENT DOCUMENTS

| | | | | |
|---|---|---|---|---|
| 3,729,397 | A | 4/1973 | Goldsmith et al. | |
| 4,828,658 | A * | 5/1989 | Bertaud | 205/365 |
| 5,314,526 | A | 5/1994 | Sharma | |
| 5,395,487 | A | 3/1995 | Sharma | |
| 5,932,084 | A | 8/1999 | Takamaru | |
| 5,976,345 | A * | 11/1999 | Pal et al. | 205/336 |
| 6,299,742 | B1 | 10/2001 | Pal et al. | |

OTHER PUBLICATIONS

International Search Report issued for PCT/US11/063334, dated Apr. 5, 2012 (1 page).

* cited by examiner

*Primary Examiner* — Zulmariam Mendez

(74) *Attorney, Agent, or Firm* — Wilmer Cutler Pickering Hale and Dorr LLP

(57) ABSTRACT

In one aspect, the present invention is directed to methods for extracting rare earth metals from ores comprising reduction of rare earth metal oxyfluorides. In another aspect, the invention relates to an apparatus for extracting rare earth metals from ores comprising reduction of rare earth metal oxyfluorides. The methods and apparatuses described herein generate rare earth metals from ores with reduced requisite pre-removal of metal oxides found as natural impurities in ores.

16 Claims, 4 Drawing Sheets

200

METHODS AND APPARATUS FOR PROCESSING OF RARE EARTH METAL ORE

CROSS-REFERENCE TO RELATED APPLICATIONS

This application is a national stage application of prior International Application No. PCT/US2011/063334, entitled "Methods and Apparatus for Processing of Rare Earth Metal Ore", filed on Dec. 5, 2011, which claims the benefit of and priority to U.S. provisional patent application Ser. No. 61/419,871 filed Dec. 5, 2010, the disclosure of each of which is hereby incorporated by reference in its entirety for all purposes.

All publications, patent applications, patents, and other references mentioned herein are incorporated by reference in their entirety. The patent and scientific literature referred to herein establishes knowledge that is available to those skilled in the art. The issued patents, applications, and other publications that are cited herein are hereby incorporated by reference to the same extent as if each was specifically and individually indicated to be incorporated by reference. In the case of inconsistencies, the present disclosure will prevail.

BACKGROUND OF THE INVENTION

1. Field of the Invention

Embodiments of the invention relate to production of rare earth metals and/or metal mixtures from rare earth metal compound containing mixtures.

2. Description of Related Art

Rare earth metals, comprising metals of the series in the periodic table from lanthanum to lutetium, are very costly to extract from their respective ores. In large part, the cost is due to the large amount of waste, chiefly aqueous waste, that is generated by all stages of processing mined ore into mineral concentrate, leached concentrate, and the many intermediates between this and finished metal product. This very large volume of metal-contaminated aqueous waste renders prevention of emissions according to environmental regulations prohibitively costly. For these reasons, the Mountain Pass rare earth metal mine and processing facility in California, which is the largest such facility in the United States for decades, ceased its mining and processing operations in 1998, and only resumed in 2011.

Extraction of metals from their corresponding ores can be performed either by electrochemical or pyrometallurgical processes. The most commonly used method of pyrometallurgical process is smelting, wherein the ore is heated with a reducing agent to change the oxidation state of the metal ore and thereby generate the metal. Most ores are impure, thus requiring a flux, such as limestone, to combine with the byproducts and unreacted ore in order generate slag. Slag is subsequently removed to provide the refined metal.

The most commonly used method of electrochemical extraction is electrolysis, wherein the metal-containing ore is dissolved into a solution or melted to induce dissociation into its corresponding ionic components. Application of an electric potential across electrodes in the solution/melt induces reductive deposition of the metal at the cathode. Drawbacks of conventional electrolytic refining processes include decreased efficiency of refinement of metals with multiple oxidation states, which becomes increasingly relevant with respect to rare earth metals. Rare earth metals pose additional refinement and extraction challenges due to their very close electronegativities, which can complicate the electrochemical process.

Recent development of the solid oxide membrane (SOM) electrolysis process has provided an alternative electrochemical method for refinement of metal oxides (see, for example, U.S. Pat. Nos. 5,976,345 and 6,299,742). The SOM process comprises a solid oxygen ion-conducting membrane (SOM) typically consisting of zirconia stabilized by yttria (YSZ) or other low valence oxide-stabilized zirconia, for example, magnesia- or calcia-stabilized zirconia (MSZ or CSZ, respectively) in physical contact with the molten salt bath, an anode in ion-conducting contact with the solid oxygen ion-conducting membrane, and a power supply for establishing a potential between the cathode and anode. The metal cations are reduced to metal at the cathode, and oxygen ions migrate through the membrane to the anode where they are oxidized to produce oxygen gas. The SOM blocks ion cycling, which is the tendency for subvalent cations to be re-oxidized at the anode, by removing the connection between the anode and the metal ion containing molten salt. The SOM also protects and enables the use of a variety of oxygen-producing inert anodes to achieve high purity oxygen by-products and prevents back reaction (oxidation of the metal deposited at the cathode) via physical separation of the cathode product from the oxygen. The first demonstration of the SOM process produced a few tenths of a gram of iron and silicon in a steelmaking slag, and the process has made progress toward the production of other metals such as magnesium, tantalum and titanium (see, for example, U.S. Pat. No. 6,299,742; Pal and Powell, *JOM* 2007, 59(5):44-49; *Metall. Trans.* 31B:733, August 2000; Krishnan et al, *Metall. Mater. Trans.* 36B:463-473 (2005); and Krishnan et al, *Scand. J. Metall.* 34(5): 293-301 (2005)).

In the context of rare earth metals, extraction presents unique challenges, including very close electronegativities. Although reduction of rare earth metal oxides dissolved in molten salts has been demonstrated (see, Kaneko et al, *J. Alloys & Compounds* 1993, 193:44-46), commercial application of such processes remains prohibitive due to at least two reasons: 1) they require expensive pure rare earth metal oxides as a starting point, and 2) with multi-valent species such as cerium (which can exist in a $3^+$ or $4^+$ ion as well as a metal), electrolysis current efficiency is typically very low. SOM electrolysis in part overcomes these limitations by producing high-purity metals from moderate-purity oxides and by blocking ion cycling (see, WO/2010/126597). However, the SOM process requires the input of a relatively pure rare earth metal oxide or mixture of oxides in lieu of mineral ores that contain metal oxyfluorides. Prior to feeding into the SOM process, the naturally impure mineral ores must be processed to separate and refine the rare earth oxyfluorides to remove non-rare earth oxides such as calcium oxide or barium oxide, followed by conversion of the oxyfluorides to rare earth oxides. The rare earth oxides can then be fed into the SOM process.

Thus, there remains a need for more efficient and scalable apparatuses and processes to directly process rare earth metal oxide containing ore into pure metals.

BRIEF SUMMARY OF THE INVENTION

In one aspect of the invention, a method for processing rare earth metal ore is provided.

In another aspect of the invention, a method of extracting rare earth metal from mixtures comprising rare earth metal compounds includes providing a first molten salt mixture comprising a group II fluoride and a rare earth metal fluoride present in a first ratio and providing a feedstock mixture comprising a rare earth metal oxyfluoride and a group II oxide present in a second ratio. The second ratio is such that chemical conversion of the rare earth metal oxyfluorides and group II oxides to rare earth oxides, group II fluorides, and rare earth fluorides generates group II fluorides and rare earth metal fluorides in about the same ratio as the first ratio. The method also includes combining the first molten salt mixture and the feedstock mixture to form a reaction mixture. The reaction mixture comprises oxide ions. The method also includes providing a first cathode in electrical contact with the reaction mixture and providing an anode, wherein the anode is in ion-conducting contact with an oxide ion-conducting membrane. The oxide ion-conducting membrane is in ion-conducting contact with the reaction mixture. The method also includes generating a potential between the anode and the first cathode to reduce the metallic species of the rare earth metal oxyfluoride at the first cathode, transport oxide ions across the oxide ion-conducting membrane, and oxidize the oxide ions at the anode and collecting the reduced rare earth metallic species.

In a further aspect of the invention, the method includes providing a second molten salt. The second molten salt is in ion-conducting contact with the oxide ion-conducting membrane and the anode. The second molten salt is not in physical contact with the first molten salt.

In yet another aspect of the invention, the first molten salt mixture is at least about 90% liquid, and, optionally, at least about 95% liquid.

In still a further aspect of the invention, the group II fluoride and the rare earth fluoride are at the eutectic composition.

In another aspect of the invention, the rare earth metal oxyfluoride and at least a portion of the group II oxide are present in a same ore.

In still a further aspect of the invention, providing a feedstock mixture comprises (a) determining a third ratio of a rare earth metal oxyfluoride to a group II oxide present in a raw metal source mixture, and (b) adjusting the third ratio of the rare earth metal oxyfluoride to the group II oxide present in the raw metal source mixture to obtain the second ratio. Optionally, the adjusting includes adding material comprising group II oxides or removing at least a portion of group II oxides.

In another aspect of the invention, a system for extracting rare earth metal from mixtures comprising rare earth metal compounds includes a container comprising a reaction mixture. The reaction mixture comprising (a) a first molten salt mixture comprising a group II fluoride and a rare earth metal fluoride present in a first ratio and (b) a feedstock mixture comprising a rare earth metal oxyfluoride and a group II oxide present in a second ratio, the second ratio being such that chemical conversion of the rare earth metal oxyfluorides and group II oxides to rare earth oxides, group II fluorides, and rare earth fluorides generates group II fluorides and rare earth metal fluorides in about the same ratio as the first ratio. The system also includes a first cathode in electrical contact with the reaction mixture, an oxide ion-conducting membrane in ion-conducting contact with the reaction mixture, and an anode in ion-conducting contact with an oxide ion-conducting membrane. The system further includes a power source for generating a potential between the anode and the first cathode to reduce the metallic species of the rare earth metal oxyfluoride at the first cathode, transport oxide ions present in the reaction mixture across the oxide ion-conducting membrane, and oxidize the oxide ions at the anode.

In yet another aspect of the invention, the container further comprises a second molten salt. The second molten salt is in ion-conducting contact with the oxide ion-conducting membrane and the anode, and the second molten salt is not in physical contact with the first molten salt.

In a further aspect of the invention, the system further comprises a second cathode to reduce a second rare earth metallic species.

Any of the above aspects can be combined with any one or more of the above aspects.

BRIEF DESCRIPTION OF THE SEVERAL VIEWS OF THE DRAWINGS

The following figures are provided for the purpose of illustration only and are not intended to be limiting.

DETAILED DESCRIPTION

Described herein are methods and apparatuses useful for obtaining a mixture of rare earth metals, commonly known as "mischmetal", or individual rare earth metal elements, from ores containing bastnäsite or similar minerals including rare earth oxides. Bastnäsite has the chemical formula $RECO_3F$, wherein RE represents one or more rare earth metals. Rare earth metals comprise metals from the lanthanide series in the chemical periodic table from lanthanum to lutetium as well as scandium and yttrium. Scandium is considered a rare earth element, though it usually occurs in minor amounts. Yttrium is considered a rare earth element because it often occurs with rare earth metals in nature and has similar chemical properties. Other metal fluorocarbonates, such as thorium fluorocarbonate, may also be used as a rare earth metal in the context of the invention. Calcine bastnäsite refers to a bastnäsite material that is heated to drive off carbon dioxide leaving behind rare earth oxyfluoride (REOF).

Figure 1:
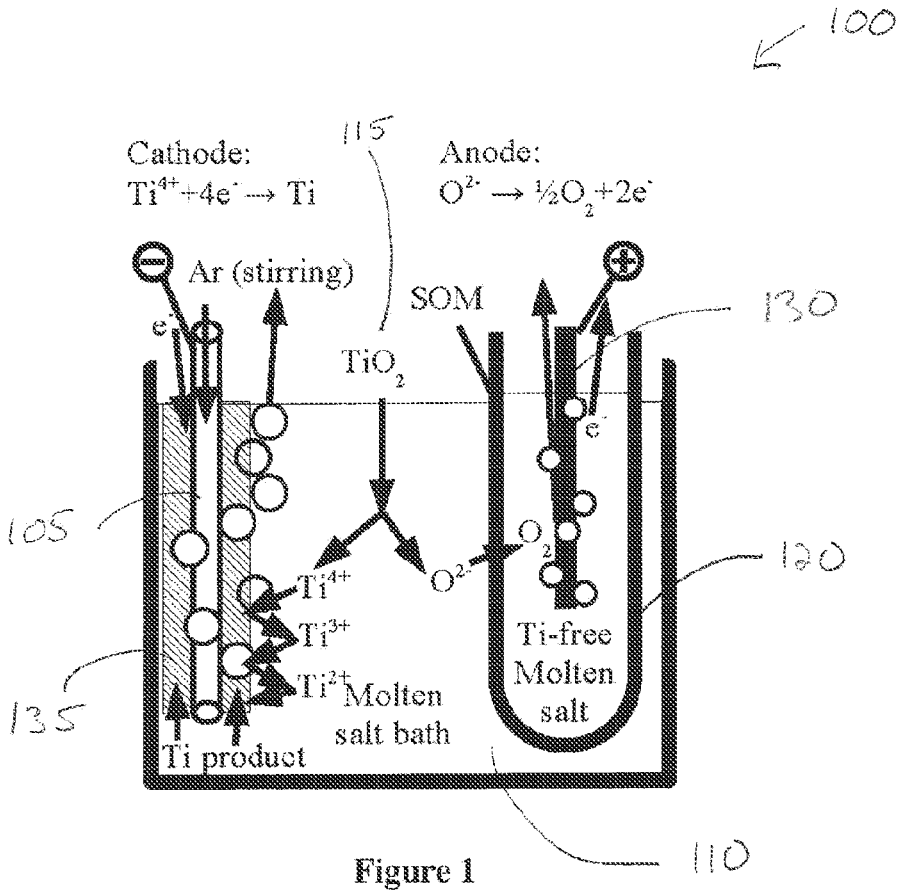
Figure 1 Prior Art
FIG. 1. A schematic illustration of the SOM process for making titanium from $TiO_2$.

Recent development of the solid oxide membrane (SOM) electrolysis process has provided an alternative method for refinement of metal oxides (see, for example, U.S. Pat. Nos. 5,976,345, and 6,299,742; each herein incorporated by reference in its entirety). The process as applied to titanium production is shown in FIG. 1. The apparatus 100 consists of a metal cathode 105, a molten salt electrolyte bath 110 that dissolves the metal oxide 115 (for example, titanium dioxide) which is in electrical contact with the cathode, a solid oxygen ion conducting membrane (SOM) 120 typically consisting of zirconia stabilized by yttria (YSZ) or other low valence oxide-stabilized zirconia, for example, magnesia- or calcia-stabilized zirconia (MSZ or CSZ, respectively) in ion-conducting contact with the molten salt bath 110, an anode 130 in ion-conducting contact with the solid oxygen ion-conducting membrane, and a power source for establishing a potential between the cathode and anode. The power source can be any of the power sources suitable for use with SOM electrolysis processes and are known in the art.

The metal cations are reduced to metal 135 at the cathode, and oxygen ions migrate through the membrane to the anode where they are oxidized to produce oxygen gas. The SOM blocks ion cycling, which is the tendency for subvalent cations to be re-oxidized at the anode, by removing the connection between the anode and the metal ion containing molten salt because the SOM and the molten salt inside it conduct only oxide ions, not electrons (see, U.S. Pat. Nos. 5,976,345, and 6,299,742; each herein incorporated by reference in its entirety); however the process still requires input of a relatively pure rare earth metal oxide in lieu of mineral ores that contain such metal oxides. The standard SOM processes are incompatable with processing of rare earth fluorocarbonates, which is often a naturally occurring form of rare earths. Prior to feeding into the traditional SOM process, the naturally impure mineral ores must be processed to separate and refine the rare earth oxyfluorides to remove non-rare earth oxides such as calcium oxide or barium oxide, followed by conversion of the oxyfluorides to rare earth oxides. Standard SOM processes such as those described previously do not process through rare earth oxyfluorides because insufficient oxygen ions are present such as to reduce all of the rare earth metal. Incomplete reduction of the rare earth causes rare earth fluorides ($REF_3$), which eventually become insoluble, begin to accumulate in the molten salt and impede transport. Rather, previous SOM processes required the use of metal oxides, and render the extraction of rare earth metals laborious and inefficient. The processes described herein do not require exhaustive removal of minerals such as, for example, calcite, barite, celestite, and/or strontianite. These minerals often occur in ore with bastnäsite.

Figure 2:
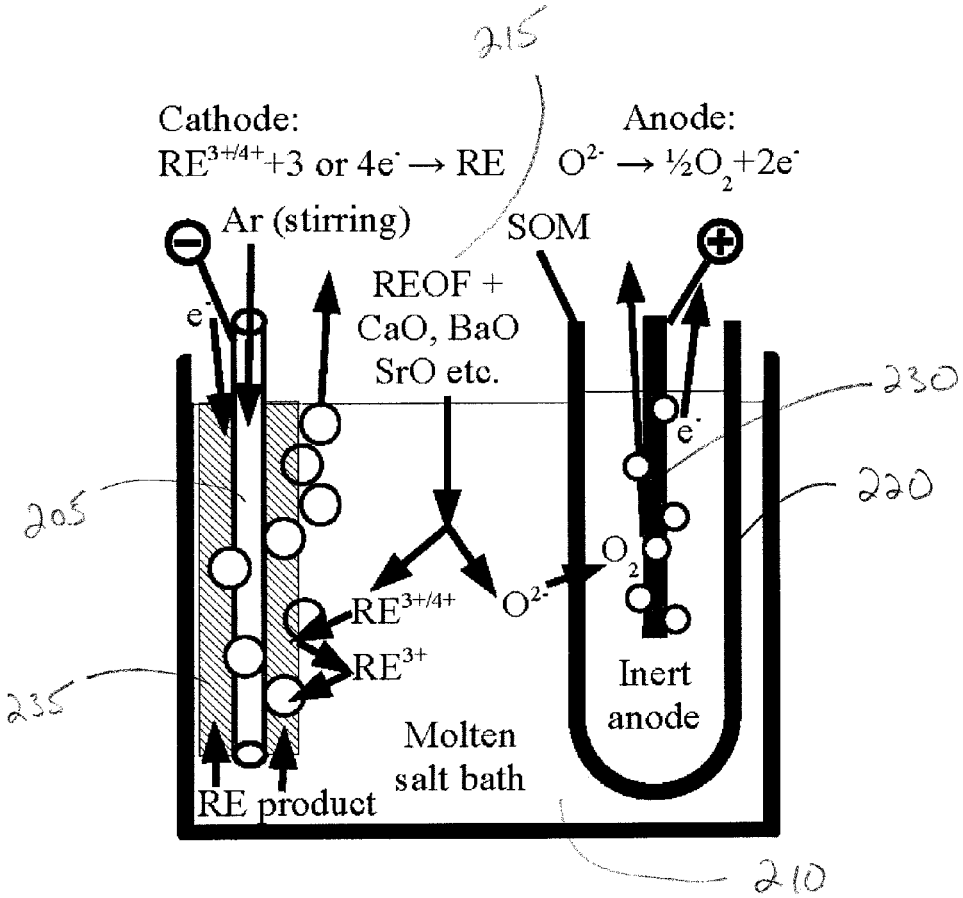
FIG. 2. A schematic illustration of some embodiments of the SOM process for making rare earth metals (RE) from rare earth oxyfluorides such as calcined bastnäsite.

FIG. 2 shows an apparatus 200 for use with embodiments of the present invention. The apparatus 200 consists of a cathode 205, a molten salt electrolyte bath 210 that dissolves the metal mixture 215 containing rare earth elements which is in electrical contact with the cathode 205, a solid oxygen ion conducting membrane 220 typically consisting of zirconia stabilized by yttria or other low valence oxide-stabilized zirconia, for example, magnesia- or calcia-stabilized zirconia in ion-conducting contact with the molten salt bath, an anode 230 in ion-conducting contact with the solid oxygen ion-conducting membrane 220, and a power supply for establishing a potential between the cathode 205 and the anode 230. The metal cations are reduced to metal 235 at the cathode, and oxygen ions migrate through the membrane to the anode where they are oxidized to produce oxygen gas.

In one aspect, the apparatus is a SOM electrolysis cell comprising; a) a container, wherein the container contains a first molten salt, wherein the first molten salt is at least about 90% liquid and comprises a group II fluoride and a rare earth metal fluoride; b) a rare earth metal oxide or oxyfluoride; c) a cathode in electrical contact with the molten salt; d) an anode in ion-conducting contact with the oxide ion-conducting membrane, or a second molten salt in ion-conducting contact with the oxide ion-conducting membrane, wherein the second molten salt is not in physical contact with the first molten salt, and an anode in ion-conducting contact with the second molten salt; e) an apparatus for establishing a potential between the anode and cathode; and, optionally f) an oxide of a metal less electronegative than the rare earth metals in rare earth metal oxide or oxyfluoride, wherein the oxide of the less electronegative metal is dissolved in the molten salt.

In one aspect, the apparatus is a SOM electrolysis cell comprising; a) a container, wherein the container contains a first molten salt, wherein the first molten salt is at least about 90% liquid and comprises a group II fluoride and a rare earth metal fluoride; b) a rare earth metal oxyfluoride; c) a cathode in electrical contact with the molten salt; d) an anode in ion-conducting contact with the oxide ion-conducting membrane or a second molten salt, wherein the second molten salt is in ion-conducting contact with an oxide ion-conducting membrane; e) an apparatus for establishing a potential between the anode and cathode; and, optionally f) an oxide of a metal less electronegative than the rare earth metals in rare earth metal oxyfluoride, wherein the oxide of the less electronegative metal is dissolved in the molten salt.

In some embodiments, the anode is in ion-conducting contact with the oxide ion-conducting membrane. In some embodiments, the second molten salt is not in physical contact with the first molten salt. In some embodiments, a second molten salt is in ion-conducting contact with the oxide ion-conducting membrane, wherein the second molten salt is not in physical contact with the first molten salt, and an anode is in ion-conducting contact with the second molten salt.

In one aspect, the invention relates to a method of extracting rare earth metal from ores comprising: providing a cathode in electrical contact with a first molten salt, wherein the first molten salt comprises a group II fluoride, a rare earth metal fluoride, and a rare earth metal oxide or oxyfluoride, and wherein the molten salt is at a temperature of from about 1000° C. to about 2000° C.; providing an anode, wherein the anode is in ion-conducting contact with an oxide ion-conducting membrane or a second molten salt, wherein the second molten salt is in ion-conducting contact with an oxide ion-conducting membrane; and generating a potential between the anode and cathode, thereby reducing the metallic species of the rare earth metal oxide or oxyfluoride at the cathode, transporting the anionic species of the first molten salt across the ionic membrane and oxidizing the anionic species at the anode; and collecting the reduced rare earth metallic species.

In one aspect, the invention relates to a method of extracting rare earth metal from ores comprising: providing a cathode in electrical contact with a first molten salt, wherein the first molten salt is at least about 90% liquid and comprises a group II fluoride, a rare earth metal fluoride, and a rare earth metal oxyfluoride; providing an anode, wherein the anode is in ion-conducting contact with an oxide ion-conducting membrane or a second molten salt, wherein the second molten salt is in ion-conducting contact with an oxide ion-conducting membrane; and generating a potential between the anode and cathode, thereby reducing the metallic species of the rare earth metal oxyfluoride at the cathode, transporting the anionic species of the first molten salt across the ionic membrane and oxidizing the anionic species at the anode; and collecting the reduced rare earth metallic species.

In some embodiments, the cell comprises a rare earth metal oxide. In some embodiments, the cell comprises a rare earth metal oxyfluoride.

In some embodiments, the ore comprises a rare earth metal fluorocarbonate. In some embodiments, the rare earth metal ore has been previously processed to convert the rare earth fluorocarbonate to a rare earth oxyfluoride.

In some embodiments, the first molten salt is at least about 90% liquid. In some embodiments, the first molten salt is at least about 92% liquid. In some embodiments, the first molten salt is at least about 95% liquid. In some embodiments, the first molten salt is at least about 98% liquid. In some embodiments, the first molten salt is at least about 99% liquid.

In some embodiments, the group II fluoride and the rare earth oxyfluoride are present in at least about 90% liquid phase in the molten salt. In some embodiments, the group II fluoride and the rare earth oxyfluoride are present in at least about 92% liquid phase in the molten salt. In some embodiments, the group II fluoride and the rare earth oxyfluoride are present in at least about 95% liquid phase in the molten salt. In some embodiments, the group II fluoride and the rare earth oxyfluoride are present in at least about 98% liquid phase in the molten salt. In some embodiments, the group II fluoride and the rare earth oxyfluoride are present in at least about 99% liquid phase in the molten salt.

In some embodiments, the first molten salt comprises a rare earth metal oxide. In some embodiments, the first molten salt comprises a rare earth metal oxyfluoride. In some embodiments, the first molten salt comprises a group II fluoride, a rare earth metal fluoride, and a rare earth metal oxide. In some embodiments, the first molten salt comprises a group II fluoride, a rare earth metal fluoride, and a rare earth metal oxyfluoride.

In some embodiments, the second molten salt is not in physical contact with the first molten salt.

The processes and apparatuses described herein entail the use of modified SOM processes that enable extraction of rare earth metals. Representative embodiments of the SOM apparatus and process may be found, for example, in U.S. Pat. Nos. 5,976,345; 6,299,742; and *Mineral Processing and Extractive Metallurgy* 117(2):118-122 (June 2008); *JOM Journal of the Minerals, Metals and Materials Society* 59(5):44-49 (May 2007); *Metall. Mater. Trans.* 36B:463-473 (2005); *Scand. J. Metall.* 34(5):293-301 (2005); and International Patent Application Publication Nos. WO 2007/011669 and WO 2010/126597; each of which hereby incorporated by reference in its entirety.

The anode and/or cathode may be any type of electrode known in the art, including, for example, plasma electrodes or metal-ion electrodes. Other electrodes will be within the purview of the ordinarily skilled artisan.

The rare earth metal cations from the rare earth oxyfluoride or oxide mineral, shown as $Re^{3+/4+}$ in FIG. 2, form a metal deposit on the cathode that can be withdrawn from the apparatus. The oxygen anions from both the rare earth oxyfluoride or oxide mineral, and also the oxide of the less electronegative metal travel through the solid oxide membrane and optionally through the second molten salt to the anode, where they are oxidized at an inert anode such as, for example, those described in International Patent Publication No. WO/2007/011669 (herein incorporated by reference in its entirety), to form oxygen gas, or by chemical reaction with carbon or other fuel to form one or more compounds such as, for example, carbon monoxide, carbon dioxide or water. The overall chemical reaction in the case of oxygen formation can be written as:

$$REOF+\tfrac{1}{2}(CaO,BaO,SrO,etc.)\rightarrow RE+3/2O_2+\tfrac{1}{2}(CaF_2,BaF_2,SrF_2,etc.)$$

The process can be used to separate individual elements or to separate heavy rare earths from light rare earths. The process can use oxides that occur with many ore bodies and can also remove other metals. Thus, upstream ore separation is considerably simplified and can result in clean, efficient and low-cost ore-to-product process flows.

Figure 3:
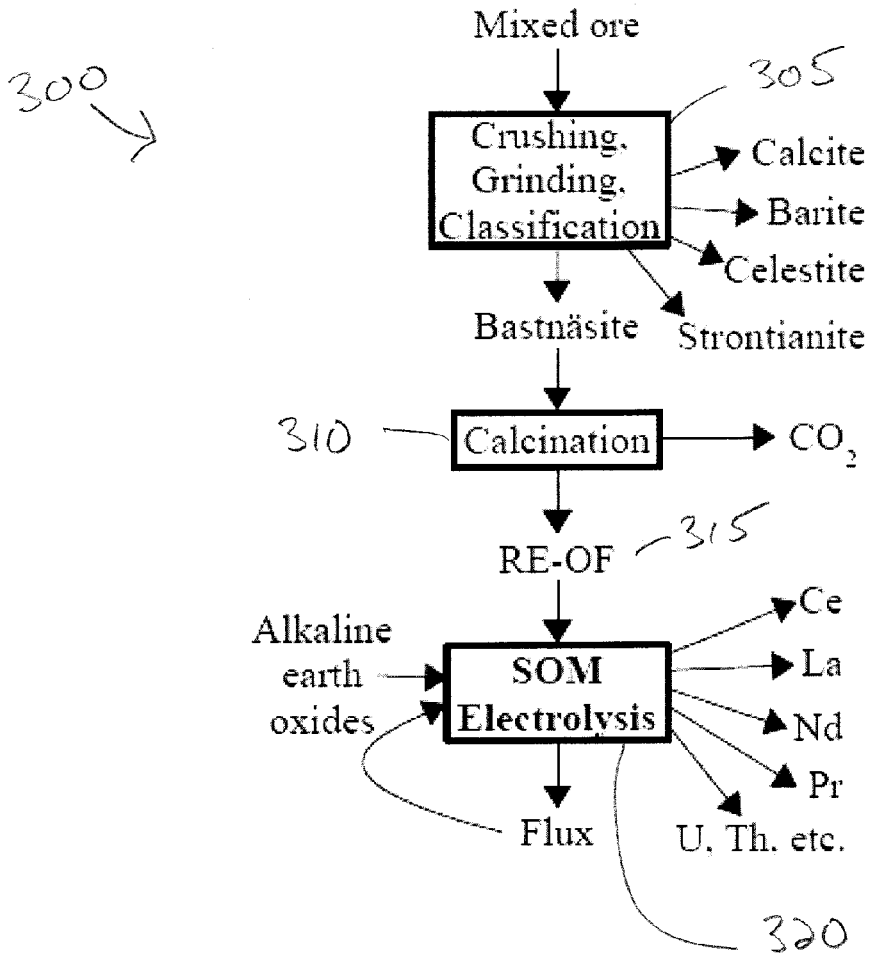
FIG. 3. A flow chart of the SOM process for processing rare earth ore according to some embodiments of the invention.

A flow chart of a process 300 for processing rare earth ores or bastnäsite according to some embodiments of the invention is shown in FIG. 3. The mixed ore can be processed into bastnäsite by crushing, grinding, and/or classification 305. The bastnäsite is then calcinated 310 to produce rare earth oxyfluoride 315. The rare earth oxyfluorides 315 are then subjected to the SOM electrolysis process 320 disclosed herein. As described in more detail below, particular mixtures of group II metal oxides (alkaline earth oxides) and rare earth oxyfluorides are dissolved in molten salt electrolytes, which are matched to the oxide-oxyfluoride mixtures. The reduced rare earth metals than can be deposited at the cathode and isolated.

In some embodiments, the process or method produces a mixture of rare earth metals known as "mischmetal".

Figure 4:
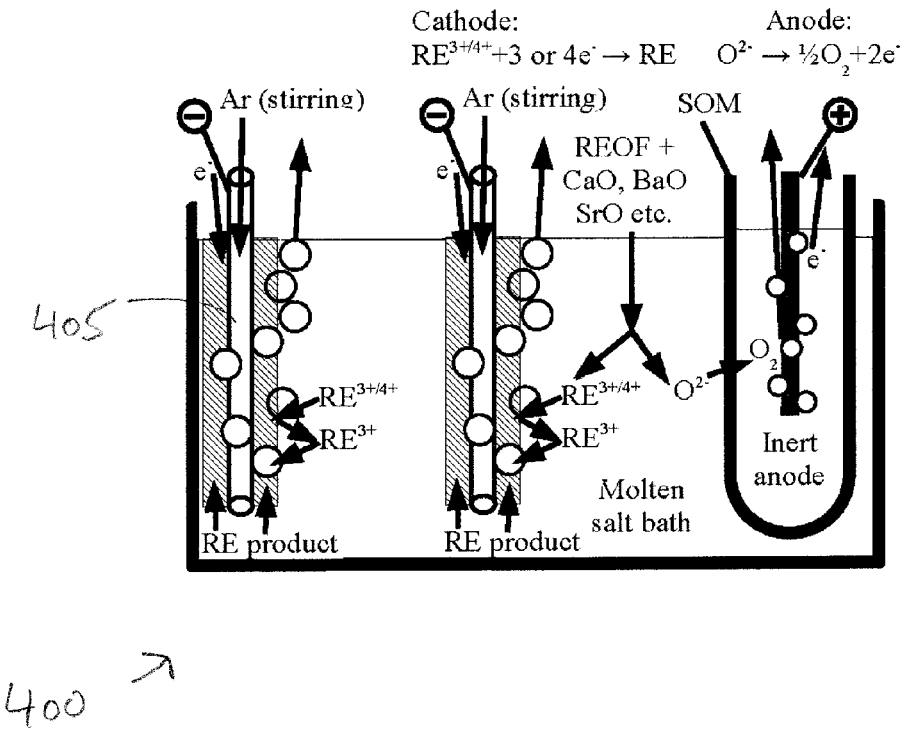
FIG. 4. A schematic illustration of an SOM process for processing rare earth ore according to some embodiments of the invention comprising more than one cathode.

In some embodiments, two or more cathodes or sets of cathodes are used in sequence to sequentially and separately reduce the metal cations in the molten salt bath. In some embodiments, the cathodes are in electrical contact with the first molten salt. In some embodiments, a potential can be applied between the anode and the first cathode to reduce more electronegative impurity metals (such as, for example, iron, silicon and aluminum) than the rare earth metals and optionally some of the rare earth metals, then between the anode and the second cathode in order to reduce the rare earth metals. FIG. 4 provides an exemplary apparatus 400 with a second cathode 405. The other components of FIG. 4 are the same or similar to those described in FIG. 2. This is method is similar to the method of pure element production described in International Patent Publication No. WO/2010/126597 (herein incorporated by reference in its entirety). In some embodiments, a first potential can be applied between the anode and the first cathode to reduce the most electronegative rare earth metal, then a second potential that is slightly higher than the first potential can be applied between the first cathode and the second cathode to reduce the second-most electronegative rare earth metal. These exemplary processes can also be repeated in an iterative fashion so as to reduce rare earth metals of differing electronegativity from a mixture comprising several different rare earth metal oxides. In some embodiments, the iterative fashion has increasing potential. In some embodiments, the multiple cathodes or sets of cathodes can be inserted to effect electrical contact with the molten salt when potential is applied, and removed when potential is applied to other cathodes, thereby reducing cross-contamination between the metal deposits.

In some embodiments, the method and/or apparatus produces one or more molten fluoride salts, which can be optionally re-used as the first molten salt in the same process.

Thus, in some embodiments, the processes described herein do not require prior refinement of the ore to obtain rare earth oxyfluoride or conversion of the same to a rare earth oxide.

In some embodiments, the processes described herein do not require prior refinement of the rare earth oxyfluoride or conversion of the same to a rare earth oxide.

DEFINITIONS

As used herein and in the appended claims, the singular forms "a," "an," and "the" include plural references unless the content clearly dictates otherwise.

The term "about" is used herein to mean approximately, in the region of, roughly, or around. When the term "about" is used in conjunction with a numerical range, it modifies that range by extending the boundaries above and below the numerical values set forth. The term "about" is used herein to modify a numerical value above and below the stated value by a variance of 20%.

Bastnäsite often co-occurs in an ore with one or more of calcite ($CaCO_3$), barite ($BaSO_4$), celestite ($SrSO_4$), and/or strontianite ($SrCO_3$) (see, for example, W. Warhol, "Molycorp's Mountain Pass Operations," in D. L. Fife and A. R. Brown eds. *Geology and Mineral Wealth of the California Desert*, South Coast Geological Society, 1980; herein incorporated by reference in its entirety). Thus, in some embodiments, the processes of the invention provide an incomplete separation of the ore into its constituent minerals. That is, instead of using a process to separate the natural ore to yield 95 mol % or more bastnäsite concentrate for calcination and SOM electrolysis, one can use a process to yield about 60 mol % to about 80 mol % or greater bastnäsite concentrate, and then calcine that mixture all at once to drive off gases such as carbon monoxide, carbon dioxide, sulfur dioxide, and/or sulfur trioxide and use SOM electrolysis to extract the metals. This is advantageous because halides such as fluorides of calcium, barium and strontium, which are among the products of SOM electrolysis, are also favorable for use as the first molten salts in the SOM electrolysis process. Further advantages can include, for example, simpler process, a less costly process, a less energy-intensive process, a less environmentally harmful process or other favorable characteristics.

In some embodiments, the rare earth metal oxide is an impure rare earth metal ore. In some embodiments, the rare earth metal oxide has not been previously processed to purify the metal oxide. In some embodiments, the ore or oxide mixture has not been previously processed to purify the metal oxide. In some embodiments, the ore comprises a rare earth metal fluorocarbonate. In some embodiments, the rare earth metal ore has been previously processed to convert the rare earth fluorocarbonate to a rare earth oxyfluoride.

In some embodiments, the ores comprise oxides and/or oxyfluorides of rare earth metals. In some embodiments, the ores comprise oxides of rare earth metals. In some embodiments, the ores comprise oxyfluorides of rare earth metals. In some embodiments, the rare earth metal oxyfluoride is calcined bastnäsite.

In some embodiments, the apparatus or method comprises extraction of rare earth metals from mixtures of rare earth metal oxides or ores.

In some embodiments, the molten salt further comprises lithium fluoride. It has been found that lithium fluoride provides for a lower eutectic temperature than group II fluorides.

Preferably, salt systems for the molten salt satisfy criteria such as, for example, oxide free energy, low melting point, target oxide solubility, low volatility, zirconia stability, high ionic conductivity and low electronic conductivity. In some implementations, the minimum conductivity is 0.001 S/cm. In other implementations, the minimum conductivity is 0.1 S/cm.

It is preferable that cation species have oxide free energies of formation that are more negative than that of the target metal for production, such that the process minimizes reduction of flux cations along with the product. For rare earth metal production, preferred cation species are calcium, strontium, barium, lithium, potassium, cesium, and yttrium. Sodium has lower electronegativity than rare earths and many other elements; however the oxide free energy of sodium is less negative, so sodium oxide present in the flux can be reduced and evaporates at the cathode before rare earths and even magnesium.

Though original SOM electrolysis processes were in steelmaking slags at about 1600° C., it has been discovered that the process is more stable and energy-efficient at lower temperatures. Thus, temperature ranges between about 700° C. and about 1300° C. provide a good balance between energy efficiency and apparatus stability at lower temperature, and good ion oxide conductivity in stabilized zirconia at higher temperature. Preferably, the flux is a liquid in these temperature ranges.

Preferably, the flux dissolves the target oxide to at least about 2-3 weight percent in order to achieve ionic current density at the cathode and anode. For example, differential scanning calorimetry (DSC) and/or differential thermal analysis (DTA) experiments at various compositions can efficiently characterize oxide solubility.

Preferably, the flux exhibits very low vapor pressure and evaporation rate in the process temperature range. For example, combining thermogravimetric analysis (TGA) with DSC or DTA experiments can efficiently evaluate the flux evaporation rate.

Preferably, species in the flux have high ionic conductivity and, optionally, low viscosity such that high current density is supported without significant transport limitation. A high viscosity flux may inhibit mass transfer to the SOM and the cathode; at the SOM oxygen ions may be depleted in the boundary layer, reducing the current, and at the cathode the target metal ions may be depleted in the boundary layer thereby reducing and co-depositing flux cations. Exemplary fluxes without silica or alumina and with high fluoride/oxide ratios provide high ionic conductivity.

Preferably, the flux has low electronic conductivity in order to avoid functioning as a cathode and minimize the possibility of zirconia reduction. Preferably, the flux does not dissolve or corrode the solid electrolyte (such as, for example, the zirconia). Preferably, the flux exhibits optical basicity and stabilizing oxide (such as, for example, yttria) chemical potential that are both close to those values in the solid electrolyte (such as, for example, the zirconia). To evaluate stability, for example, the zirconia may be immersed in the flux at the process temperature for several hours (such as, for example, more than 10 hours), after which it may be sectioned and characterized. Balancing optical basicity (*J. Non-Cryst. Solids* 21(3):373-410 (1976), herein incorporated by reference in its entirety) and stabilizing oxide (such as, for example, yttria) activity in the flux with properties of the solid electrolyte (such as, for example, the zirconia) are preferable to impart long-term compatability. Basicity of the flux can be measured, for example, via a metal cation probe ion with an absorpotion edge that varies with basicity. Though numerous probes exist and will be recognized by the ordinarily skilled artisan, preferred probes are those with the best sensitivity across the entire range of optical basicity from CaO to $SiO_2$ such as the Period 6 elements with the electronic configuration of mercury (two outer s electrons and no p electrons, such as $Tl^+$, $Pb^{2+}$ and $Bi^{3+}$). The s to p transition energy of these elements changes gradually with the basicity of the surrounding environment, as does the wave number of the corresponding UV absorption peak: for $Pb^{2+}$ from 29,700 $cm^{-1}$ in CaO to 45,820 $cm^{-1}$ in $SiO_2$ to 60,700 $cm^{-1}$ for the free $Pb^{2+}$ ion. In SOM electrolysis, preferable fluxes compatible with yttria-stabilized zirconia are those with similar optical basicity.

Fluorides in the molten salt impart advantages such as, for example, melting and eutectic temperatures that are generally lower than those of the corresponding oxides; ionic diffusivities/mobilities/conductivities that are generally higher, and viscosities that are generally lower, than those of the corresponding oxides; vapor pressures are generally lower than those of the corresponding chlorides; fluoride optical basicities are lower than salts with all other anions due to fluorine being the most electronegative of all elements. When producing metals with highly basic oxides such as rare earths, magnesium, calcium and, to a lesser extent, titanium, balancing this with a less basic salt results in the overall basicity of the mixture being close to that of zirconia, which minimizes SOM corrosion.

In some embodiments, the ratio of group II fluorides and the rare earth fluorides are selected so as to form a eutectic mix. In some embodiments, the ratio of group II fluorides and the rare earth oxyfluorides are a selected so as to form a eutectic mix of group II fluorides and the rare earth fluorides. Exemplary eutectic mixes of rare earth fluorides and group II fluorides are described in http://ras.material.tohoku.ac.jp/~molten/molten_eut_query1.php, herein incorporated by reference in its entirety.

The molten salt advantageously includes both the rare earth oxyfluoride and a group II fluoride. In some embodiments, the ratio of rare earth oxyfluoride to group II fluoride is chosen such that the stoichiometric amounts are balanced. Oxide melts or molten salts are often more effective when ionic conductivity is large and the metal ions and oxide anions freely migrate through the melt or molten salt. To this end, basic oxide melts are advantageous, and can be created via addition of oxides that are electron donors such as, for example, group II oxides. In some embodiments, the group II oxide is present such that rare earth fluoride is retained in the molten salt. In some embodiments, a eutectic molten salt mixture is advantageous. Other techniques for modifying the melt are described, for example, in U.S. Pat. No. 6,299,742; herein incorporated by reference in its entirety.

In some embodiments, the molten salt is at a temperature of from about 700° C. to about 2000° C. In some embodiments, the molten salt is at a temperature of from about 700° C. to about 1600° C. In some embodiments, the molten salt is at a temperature of from about 700° C. to about 1300° C. In some embodiments, the molten salt is at a temperature of from about 700° C. to about 1200° C. In some embodiments, the molten salt is at a temperature of from about 1000° C. to about 1300° C. In some embodiments, the molten salt is at a temperature of from about 1000° C. to about 1200° C.

In some embodiments, the oxide of a metal less electronegative than the rare earth metal is a group II metal oxide. In some embodiments, the oxide of a metal less electronegative than the rare earth metal is beryllium oxide, magnesium oxide, calcium oxide, strontium oxide, barium oxide, radium oxide, or a combination thereof. In some embodiments, the oxide of a metal less electronegative than the rare earth metal is beryllium oxide, magnesium oxide, calcium oxide, strontium oxide, barium oxide, or radium oxide. In some embodiments, the oxide of a metal less electronegative than the rare earth metal is beryllium oxide, magnesium oxide, calcium oxide, strontium oxide, barium oxide, or a combination thereof. In some embodiments, the oxide of a metal less electronegative than the rare earth metal is beryllium oxide, magnesium oxide, calcium oxide, strontium oxide, or barium oxide. In some embodiments, the oxide of a metal less electronegative than the rare earth metal is magnesium oxide, calcium oxide, strontium oxide, barium oxide, or a combination thereof. In some embodiments, the oxide of a metal less electronegative than the rare earth metal is magnesium oxide, calcium oxide, strontium oxide, or barium oxide. In some embodiments, the oxide of a metal less electronegative than the rare earth metal is calcium oxide, strontium oxide, barium oxide, or a combination thereof. In some embodiments, the oxide of a metal less electronegative than the rare earth metal is calcium oxide, strontium oxide, or barium oxide.

The ionic or ion-conducting membrane is selected to resist electron transfer from the first molten salt to the anode. The ionic membrane may be an ionically conductive solid, liquid that is immiscible with the first molten salt, or a composite. Exemplary ionic membranes are described, for example, in U.S. Pat. No. 6,299,742; herein incorporated by reference in its entirety. In some embodiments, the ionic membrane comprises an ionically conductive solid. In some embodiments, the ionic membrane comprises a liquid that is immiscible with the first molten salt. In some embodiments, the ion-conducting membrane comprises a refractory metal oxide. In some embodiments, the refractory metal oxide comprises stabilized or partially stabilized zirconia. In some embodiments, the refractory metal oxide comprises inorganic solid electrolytes. In some embodiments, the inorganic solid electrolyte comprises calcium sulfide.

In some embodiments, the group II fluorides serve as electrolytes to facilitate ion migration. In some embodiments, the group II fluorides generated during the process are recycled in the process. In some embodiments, the group II fluoride is beryllium fluoride, magnesium fluoride, calcium fluoride, strontium fluoride, barium fluoride, radium fluoride, or a combination thereof. In some embodiments, the group II fluoride is beryllium fluoride, magnesium fluoride, calcium fluoride, strontium fluoride, barium fluoride, or radium fluoride. In some embodiments, the group II fluoride is beryllium fluoride, magnesium fluoride, calcium fluoride, strontium fluoride, barium fluoride, or a combination thereof. In some embodiments, the group II fluoride is beryllium fluoride, magnesium fluoride, calcium fluoride, strontium fluoride, or barium fluoride. In some embodiments, the group II fluoride is magnesium fluoride, calcium fluoride, strontium fluoride, barium fluoride, or a combination thereof. In some embodiments, the group II fluoride is magnesium fluoride, calcium fluoride, strontium fluoride, or barium fluoride. In some embodiments, the group II fluoride is calcium fluoride, strontium fluoride, barium fluoride, or a combination thereof. In some embodiments, the group II fluoride is calcium fluoride, strontium fluoride, or barium fluoride.

In some embodiments, the mischmetal comprises scandium, yttrium, lanthanum, cerium, praseodymium, neodymium, promethium, samarium, europium, gadolinium, terbium, dysprosium, holmium, erbium, thulium, ytterbium, lutetium or thorium. In some embodiments, the mischmetal comprises scandium, yttrium, lanthanum, cerium, praseodymium, neodymium, promethium, samarium, europium, gadolinium, terbium, dysprosium, holmium, erbium, thulium, ytterbium or lutetium. In some embodiments, the rare earth metal is lanthanum, cerium, praseodymium, neodymium, promethium, samarium, europium, gadolinium, terbium, dysprosium, holmium, erbium, thulium, ytterbium or lutetium. In some embodiments, the mischmetal comprises lanthanum, cerium, praseodymium, neodymium, promethium, samarium, europium, gadolinium, terbium, dysprosium, holmium, erbium, thulium, ytterbium or lutetium. In some embodiments, the mischmetal comprises lanthanum, cerium, praseodymium, or neodymium. In some embodiments, the mischmetal comprises lanthanum. In some embodiments, the mischmetal comprises cerium. In some embodiments, the mischmetal comprises praseodymium. In some embodiments, the mischmetal comprises neodymium.

In some embodiments, the rare earth metal is scandium, yttrium, lanthanum, cerium, praseodymium, neodymium, promethium, samarium, europium, gadolinium, terbium, dysprosium, holmium, erbium, thulium, ytterbium, lutetium or thorium. In some embodiments, the rare earth metal is scandium, yttrium, lanthanum, cerium, praseodymium, neodymium, promethium, samarium, europium, gadolinium, terbium, dysprosium, holmium, erbium, thulium, ytterbium or lutetium. In some embodiments, the rare earth metal is lanthanum, cerium, praseodymium, neodymium, promethium, samarium, europium, gadolinium, terbium, dysprosium, holmium, erbium, thulium, ytterbium or lutetium. In some embodiments, the rare earth metal is lanthanum, cerium, praseodymium, or neodymium. In some embodiments, the rare earth metal is lanthanum. In some embodiments, the rare earth metal is cerium. In some embodiments, the rare earth metal is praseodymium. In some embodiments, the rare earth metal is neodymium.

It will recognized that one or more features of any embodiments disclosed herein may be combined and/or rearranged within the scope of the invention to produce further embodiments that are also within the scope of the invention.

Those skilled in the art will recognize, or be able to ascertain using no more than routine experimentation, many equivalents to the specific embodiments of the invention described herein. Such equivalents are also intended to be within the scope of the present invention.

The following examples illustrate the present invention, and are set forth to aid in the understanding of the invention, and should not be construed to limit in any way the scope of the invention as defined in the claims which follow thereafter.

EXAMPLES

Example 1

Exemplary Reduction of Bastnäsite Ore

For fluorocarbonate ores such as bastnäsite at Mountain Pass (W. Warhol, "Molycorp's Mountain Pass Operations," in D. L. Fife and A. R. Brown eds. *Geology and Mineral Wealth of the California Desert*, South Coast Geological Society, 1980; herein incorporated by reference in its entirety), the ore would be calcined to drive off $CO_2$, then alkaline earth metal oxides can be used so the fluoride ions generate new flux via the overall reaction: $REOF+\frac{1}{2}(CaO/BaO/SrO \rightarrow RE+3/2O_2+\frac{1}{2}(CaF_2/BaF_2/SrF_2)$.

The alkaline earth fluoride products are reusable as the process molten salt. The Molycorp bastnäsite concentrate produced by froth floatation from raw ore without leaching is 31% CaO/SrO/BaO by mole as shown in Table 1 (based on metals in http://www.molycorp.com/data_sheets/bastnäsite/4000.htm with rare earth composition shown as oxide. $SiO_2$, $P_2O_5$ and $Fe_2O_3$ are omitted because those more electronegative metals will plate on sacrificial cathodes prior to rare earth reduction), making this material, after calcination, ideal feedstock for the extraction process. The leached bastnäsite product composition is about 70%, by weight, rare earth oxides, which is consistent with near complete removal of the group II oxides.

TABLE 1

Molycorp bastnäsite concentrate product composition.

| Component | Mass % | Molar mass | Mole % |
|---|---|---|---|
| $CeO_2$ | 30 | 172.1 | 34 |
| $La_2O_3$ | 20 | 163.9 | 24 |
| $Nd_2O_3$ | 7 | 168.2 | 8.1 |
| $Pr_6O_{11}$ | 2.4 | 170.2 | 2.7 |
| Other LnO | 0.6 | ~175 | 0.7 |
| SrO | 6 | 103.6 | 11.2 |
| CaO | 5 | 56.1 | 17.2 |
| BaO | 2 | 153.3 | 2.5 |

The general apparatus and process for SOM is described, for example, in U.S. Pat. Nos. 5,976,345 and 6,299,742; each of which hereby incorporated by reference in its entirety.

Reduction of Oxyfluoride Intermediate Ore Products to Metals:

1) Assess the target metal and major impurities in the ore product whose cations are less electronegative than the target metal. For example, in calcined Mountain Pass bastnäsite, the target "metal" is the set of rare-earths with very close electronegativities, and the impurities are: CaO, SrO and BaO.

2) Use differential thermal analysis (DTA), differential scanning calorimetry (DSC), or published literature to determine the eutectic temperature and composition between fluorides of those impurities and fluorides of the target metal. In this example, $NdF_3$ and $CaF_2$ have a eutectic at 42 mol % $CaF_2$ and 1275° C.

3) Use a similar method or methods to those of step 2 to determine the solubility of target metal oxide in this eutectic salt, in this example the rare earth oxide (REO) mixture in the ore body.

4) Provide oxyfluoride-oxide intermediate mixtures whose cation mole ratios, minus the oxide reaction product, are above and below that of the fluoride eutectic composition. For Mountain Pass bastnäsite, the bastnäsite concentrate and leached bastnäsite intermediates satisfy this criterion.

5) Determine the ratio of intermediates which produces the target oxide and fluorides at the eutectic composition. For bastnäsite concentrate, the reaction would proceed as $REOF+\frac{1}{2}(CaO/BaO/SrO) \rightarrow \frac{1}{3}RE_2O_3+\frac{1}{2}(CaF_2/BaF_2/SrF_2)$. For leached bastnäsite, the reaction would proceed as $REOF \rightarrow \frac{2}{3}RE_2O_3+\frac{1}{3}REF_3$. Thus, to achieve the 42 mol % $(CaF_2/BaF_2/SrF_2)$ determined in step 2, a mass ratio of about 1:1.9 bastnäsite concentrate:leached bastnäsite is found. The mixture of the two can be referred to as "feedstock".

6) In an electrolysis crucible with a stirring mechanism, and one or more SOM anodes, partially fill the crucible with a fluoride salt mixture at the eutectic composition, and an amount of the feedstock so their combination with the eutectic salt produces target metal oxide at or somewhat below (between about 10% of and about 100% of) its solubility limit in the eutectic salt, as determined in step 3. The crucible is selected so as to provide room to accommodate the generated eutectic salt. Alternatively, the crucible may further comprise a feature for removing the generated salts such as, for example, a siphon tube or spill over spout to a second container.

7) Seal the crucible if desired, and heat the crucible to the process operating temperature above the salt eutectic temperature. Sealing of the crucible provides for minimization of air oxidation of the metal species, and can also increase the efficiency of the process.

8) Insert the first cathodes into the molten salt/oxide mixture (hereafter "flux"), and run electrolysis by applying a potential between the first cathodes and the SOM anodes which does not reduce the target metal oxide, but which does reduce the oxides of more electronegative impurities, such as Si, Al, Fe, P, Ni, etc. See, for example, U.S. Patent Publication No. 2010/0276297 and International Patent Publication WO/2010/126597 (each of which hereby incorporated by reference in its entirety). In this case, U and Th are more electronegative than rare earths, and at a suitable potential, can plate out at the cathode, without plating out the rare earths. Run until the current is very low, indicating removal of nearly all of these impurities from the flux. Remove the first cathodes with these impurities. If the impurity mixture comes out as a liquid, it can be collected in a container within the crucible made of a material with the cathode solubility properties of step 9.

9) Insert second cathodes into the flux, preferably made of the target metal if solid at this temperature or otherwise made of a solid metal with very little (about <5%) solubility of the target metal as a solute, and which has very low (about <5%) solubility in the target metal as a solvent. See, for example, U.S. Patent Publication No. 2010/0276297 and International Patent Publication WO/2010/126597 (each of which hereby incorporated by reference in its entirety). In this example, molybdenum is a suitable cathode material.

10) Run electrolysis by applying a potential between these first cathodes and the SOM anodes which reduces the target metal oxide, in this case rare earths, but which does not reduce oxides of less electronegative impurities, such as Ca, Sr, Ba, and Li. See, for example, U.S. Patent Publication No. 2010/0276297 and International Patent Publication WO/2010/126597 (each of which hereby incorporated by reference in its entirety). Run until lower current indicates significant (between about 10% and about 90%) removal of the target metal oxide from the flux. Remove the second cathodes from the flux. In this case, if the target metal (mixture) comes out as a liquid, it can be collected in a container within the crucible made of a material with the cathode solubility properties of step 9. Optional removal of the generated salts may also be performed.

11) Add sufficient feedstock to the flux to increase its target metal oxide content back up to at or somewhat below (between about 10% of and about 100% of) its solubility limit in the eutectic salt, as determined in step 3. See, for example, U.S. Patent Publication No. 2010/0276297 and International Patent Publication WO/2010/126597 (each of which hereby incorporated by reference in its entirety). A group II metal oxide can also be added.

12) Optionally repeat steps 8-11 one or more times, but no more than fills the crucible to its safely operable capacity with the accumulated fluoride salts generated from the impurity oxides and fluorine in the target metal oxyfluoride. The first and/or second cathodes can be replaced between repetitions of these steps.

Thus, implementations of the invention provide processes that enable an SOM electrolysis cell to be used to reduce rare earth elements present as rare earth oxyfluorides in metal mixtures. In general, a molten salt electrolyte of rare earth fluorides and group II fluorides is provided in which the ratio of the rare earth fluorides and group II fluorides are such that the molten salt is at least about 90% liquid at the SOM cell operating temperature. The molten salt serves as a form of solvent for a feedstock that contains the target rare earth metal as an oxyfluoride. The feedstock is prepared to have a ratio of rare earth oxyfluorides to group II oxides such that fluorides generated by the electrolysis reactions are produced in about the same ratio as those found in the starting molten salt electrolyte. The feedstock is feed to the SOM cell in an amount at or below the solubility limit of the target rare earth metal as an oxide, taking into consideration the amount and composition of the molten salt.

The SOM cell is then operated at an electric potential to reduce the desired metal compounds. In some implementations, a sequence of reduction steps may be used to selectively remove metals. For example, a first potential is applied to selectively remove more electronegative impurities, such as Si, Al, Fe, P, Ni, etc. without removing the target rare earth metals. This is then followed by operating at a potential to remove one or more target rare earth metals without reducing the oxides of less electronegative compounds, such as Ca, Sr, and/or Ba.

In this way, embodiments of the invention enable the operation of an SOM electrolysis cell in such a way to provide a continuously renewing molten salt of desired composition as a byproduct of the target rare earth metal reduction. The group II oxides present in the feedstock provide a source of oxygen ions enabling the SOM cell to reduce the rare earth oxyfluorides.

As will be apparent to one of ordinary skill in the art from a reading of this disclosure, further embodiments of the present invention can be presented in forms other than those specifically disclosed above. The particular embodiments described above are, therefore, to be considered as illustrative and not restrictive. Those skilled in the art will recognize, or be able to ascertain, using no more than routine experimentation, numerous equivalents to the specific embodiments described herein. Although the invention has been described and illustrated in the foregoing illustrative embodiments, it is understood that the present disclosure has been made only by way of example, and that numerous changes in the details of implementation of the invention can be made without departing from the spirit and scope of the invention, which is limited only by the claims that follow. Features of the disclosed embodiments can be combined and rearranged in various ways within the scope and spirit of the invention. The scope of the invention is as set forth in the appended claims and equivalents thereof, rather than being limited to the examples contained in the foregoing description.

The invention claimed is:

1. A method of extracting rare earth metal from mixtures comprising rare earth metal compounds, the method comprising:

providing a first molten salt mixture comprising a group II fluoride and a rare earth metal fluoride present in a first ratio;

continuously providing a feedstock mixture comprising a rare earth metal oxyfluoride and a group II oxide present in a second ratio, the second ratio being such that chemical conversion of the rare earth metal oxyfluorides and group II oxides to rare earth oxides, group II fluorides, and rare earth fluorides generates group II fluorides and rare earth metal fluorides in about the same ratio as the first ratio;

combining the first molten salt mixture and the feedstock mixture to form a reaction mixture, the reaction mixture comprising oxide ions;

providing a first cathode in electrical contact with the reaction mixture;

providing an anode, wherein the anode is in ion-conducting contact with an oxide ion-conducting membrane, and the oxide ion-conducting membrane is in ion-conducting contact with the reaction mixture;

generating a potential between the anode and the first cathode to reduce the metallic species of the rare earth metal oxyfluoride at the first cathode, transport oxide ions across the oxide ion-conducting membrane, and oxidize the oxide ions at the anode; and collecting the reduced rare earth metallic species.

2. The method of claim 1, further comprising providing a second molten salt, the second molten salt being in ion-conducting contact with the oxide ion-conducting membrane and the anode, the second molten salt not being in physical contact with the first molten salt.

3. The method of claim 2, wherein the first molten salt mixture is at least about 90% liquid.

4. The method of claim 3, wherein the first molten salt is at least about 95% liquid.

5. The method of claim 1, wherein the first molten salt further comprises lithium fluoride.

6. The method of claim 1, wherein the group II fluoride and the rare earth fluoride are at the eutectic composition.

7. The method of claim 1, wherein the rare earth metal oxyfluoride and at least a portion of the group II oxide is present in a same ore.

8. The method of claim 1, further comprising providing a second cathode to reduce a second rare earth metallic species.

9. The method of claim 8, wherein a first potential is applied between the anode and the first cathode, followed by application of a second potential between the anode and the second cathode.

10. The method of claim 1, wherein the rare earth metal oxyfluoride includes calcined bastnäsite.

11. The method of claim 1, wherein the group II oxide comprises calcium oxide, barium oxide, or strontium oxide, or any combination thereof.

12. The method of claim 1, wherein the group II fluoride comprises calcium fluoride, barium fluoride, or strontium fluoride, or any combination thereof.

13. The method of claim 1, wherein the ion-conducting membrane comprises zirconia.

14. The method of claim 1, wherein the providing a feedstock mixture comprises:

determining a third ratio of a rare earth metal oxyfluoride to a group II oxide present in a raw metal source mixture; and adjusting the third ratio of the rare earth metal oxyfluoride to the group II oxide present in the raw metal source mixture to obtain the second ratio.

15. The method of claim 14, wherein the adjusting includes adding material comprising group II oxides.

16. The method of claim 14, wherein the adjusting includes removing at least a portion of group II oxides.

* * * * *